US008516617B1

(12) United States Patent
Kazmierczak

(10) Patent No.: US 8,516,617 B1
(45) Date of Patent: Aug. 27, 2013

(54) HAT WITH ENHANCED VENTILATION

(76) Inventor: Alex Kazmierczak, Seattle, WA (US)

( * ) Notice: Subject to any disclaimer, the term of this patent is extended or adjusted under 35 U.S.C. 154(b) by 766 days.

(21) Appl. No.: 12/503,720

(22) Filed: Jul. 15, 2009

(51) Int. Cl.
*A42C 5/04* (2006.01)

(52) U.S. Cl.
USPC ..... 2/181; 2/171.3; 2/182.8; 2/209.7

(58) Field of Classification Search
USPC ..... 2/181, 171.3, 182.8, 209.7, 175.1, 2/175.5
See application file for complete search history.

(56) References Cited

U.S. PATENT DOCUMENTS

| | | | | | |
|---|---|---|---|---|---|
| 2,416,062 | A * | 2/1947 | Mercer | ..... | 2/175.5 |
| 3,780,382 | A * | 12/1973 | Boden | ..... | 2/182.6 |
| 4,114,201 | A * | 9/1978 | Garrison | ..... | 2/209.7 |
| D271,250 | S * | 11/1983 | Burgin et al. | ..... | D2/875 |
| 5,495,622 | A * | 3/1996 | Kaufman | ..... | 2/175.1 |
| 7,143,451 | B2 * | 12/2006 | Lundgren | ..... | 2/171.3 |
| 2011/0016611 | A1 * | 1/2011 | Rogers | ..... | 2/171.3 |

* cited by examiner

*Primary Examiner* — Alissa Tompkins
(74) *Attorney, Agent, or Firm* — Christensen O'Connor Johnson Kindness PLLC

(57) ABSTRACT

A hat suitable for use in outdoor applications is provided. The hat provides protection from the elements, e.g., rain, wind, sun, while used in outdoor activities, such as hiking, while also providing enhanced ventilation features so that the hat may regulate heat that is either absorbed by the hat or generated by the head of the user.

14 Claims, 16 Drawing Sheets

HAT WITH ENHANCED VENTILATION

BACKGROUND

As generally known, hats provide many benefits to the wearer, including shade to protect the user's head from the direct rays of the sun. Such shade reduces glare to the wearer's eyes, protects certain areas of the wearer's body from sunburn, may reduce the effects of heat to the wearer, etc. In other instances, the hat may protect the wearer from rain, sleet, snow, and other precipitation, and/or may provide protection from the cold, wind, etc.

While the sun's rays to some degree are blocked from the wearer's head, radiant energy is absorbed by the hat and is generally conducted through the crown of the hat into the interior cavity of the hat, thereby heating the wearer's head. In conjunction with such heat being absorbed, heat generated by the wearer's body radiates outwardly from the head, which can be somewhat trapped by the crown portion of the hat and retained in close proximity to the wearer's head. Therefore, the wearer is sometimes faced with the dichotomy of wearing a hat to protect from certain conditions, such as rain, wind, glare, sunburns, etc., only to result in an increased body temperatures to the wearer due to the heat absorbed and retained by the crown.

Several conventional hats have been provided with ventilating holes through the top and/or side walls of the crown for accessing the interior cavity, or the crown was constructed out of mesh to reduce this build up of heat. Unfortunately, such efforts have had limited success in eliminating the problem of heat build up within the interior of hats, while creating further problems such as diminishing the ability to protect the wearer from other conditions, such as rain, wind, etc.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Aspects of the present invention provide a hat suitable for use in outdoor applications. The hat provides protection from the elements, e.g., rain, wind, sun, while used in outdoor activities, such as hiking, while also providing enhanced ventilation features so that the hat may regulate heat that is either absorbed by the hat or generated by the head of the user.

In one embodiment of the present invention, a hat is provided that comprises a crown defining an open ended interior cavity for receiving a user's head, a brim extending around at least a portion of the lower portion of the crown, and a ventilation system comprising at least one ventilation chamber disposed in the lower portion of the crown and fluidly connected to the interior cavity and to the exterior of the hat.

In another embodiment of the present invention, a hat is provided that comprises an upper crown portion having a top region and a lower perimeter region and a lower crown portion that defines a perimeter of an open ended, interior cavity formed by the upper and lower crown portion and sized to receive a head of a user. The lower crown portion comprises an inner band and an outer band spaced a distance outwardly from the inner band. The hat also comprises a first support member interconnecting the top region of the upper crown portion and the lower crown portion and supporting the top region of the upper crown portion a spaced distance from the lower crown portion and at least one fastener for selectively fastening at least a portion of the lower perimeter region of the upper crown portion to the lower crown portion. The hat further includes a brim extending around at least a portion of the lower portion of the crown and a ventilation system for providing ventilation to a user of the hat. The ventilation system comprises at least one chamber defined by the inner band and the outer band, at least one first chamber opening disposed in the inner band and connecting the ventilation chamber in fluid communication with the interior cavity, at least one second chamber opening disposed in the outer band and connecting the ventilation chamber in fluid communication with the exterior of the hat, and at least one aperture disposed in the brim and connected in fluid communication with the ventilation chamber.

In yet another embodiment of the present invention, a hat is provided that comprises a crown defining an open ended inner cavity. The crown has discrete upper and lower portions selectively coupled to one another. The crown has a closed position, wherein the upper portion is coupled to the lower portion, and a ventilation position, wherein at least a portion of the upper crown portion is decoupled from the lower crown portion and provides access to the inner cavity. The hat further comprises a brim extending around at least a portion of the lower portion of the crown.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Exemplary embodiments of the present invention will now be described with reference to the accompanying drawings where like numerals correspond to like elements. Exemplary embodiments of the present invention are directed to hats suitable for use in outdoor applications. In particular, embodiments of the present invention are directed to hats that provide protection from the elements, e.g., rain, wind, sun, while used in outdoor activities, such as hiking. Embodiments of the present invention are further directed to hats having enhanced ventilation features so that the hat may regulate heat that is either absorbed by the hat or generated by the head of the user and retained by the hat, while continuing to provide protection to the user from the elements.

The following discussion proceeds with reference to examples of hats with enhanced ventilation features. While these examples provided herein have been described in various detail, it will be apparent to one skilled in the art that this is done for illustrative purposes only and should not be construed as limiting the scope of the invention, as claimed. Further, it will be appreciated that embodiments of the present invention may employ any combination of features described herein.

Figure 1:
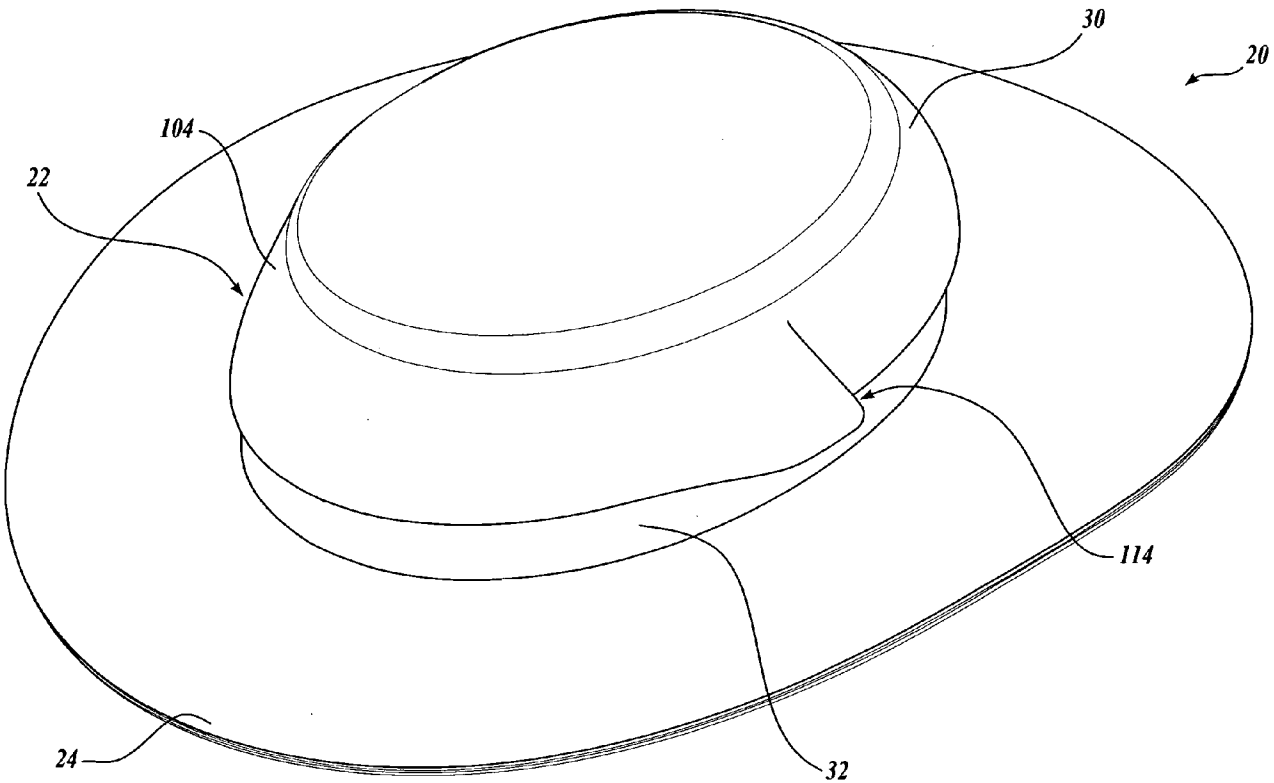
FIG. 1 is a perspective view of an exemplary hat constructed in accordance with aspects of the present invention.
Figure 2:
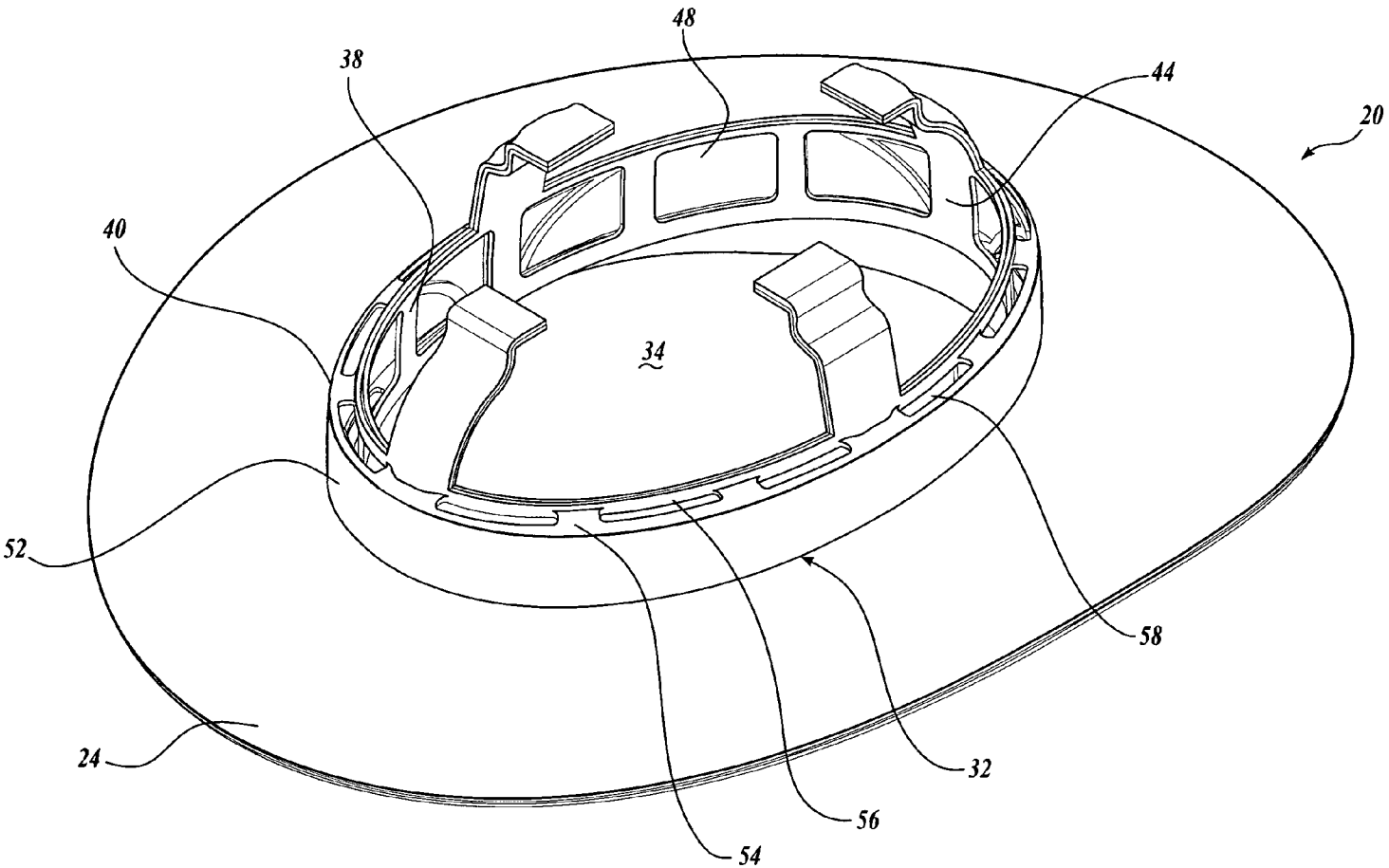
FIG. 2 is a partially perspective view of the hat of FIG. 1 with the upper crown portion removed.
Figure 3:
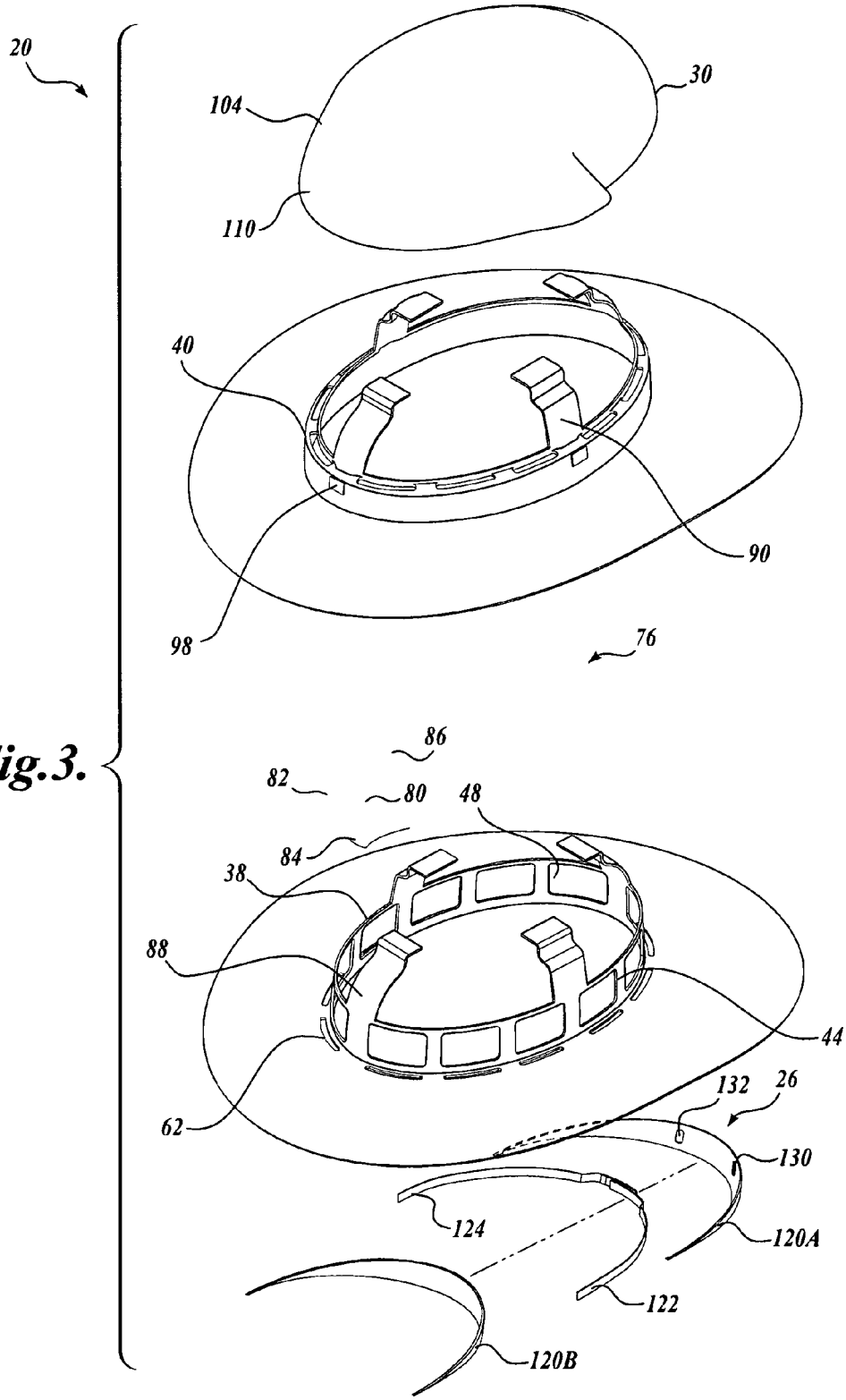
FIG. 3 is an exploded perspective view of the hat of FIG. 1.

FIGS. 1-3 illustrate one exemplary embodiment of a hat, generally designated 20, formed in accordance with aspects of the present invention. As best shown in FIGS. 1-3, the hat 20 includes a crown 22 and a brim 24. As will be described in more detail below, the hat 20 may include one or more ventilation features or systems (See FIGS. 4 and 9) that provide suitable air flow into and out of the hat 20, thereby effecting cooling to the user of the hat 20.

As best shown in FIGS. 1-3, the crown 22 of the hat 20 is formed with an upper crown portion 30 which extends across the top of the user's head and downwardly along the sides, the front, and the back of the user's head to a lower crown portion 32 which encircles the user's head. Extending outwardly therefrom in all directions is the brim 24, although other configurations where the brim extends outwardly along a portion or portions of the lower crown section 32 are possible. The brim 24 extends in a somewhat horizontal plane, although variations of this are within the scope of the invention, as claimed. In the embodiment shown in FIG. 3, the brim may be formed by a top layer 24A of suitable material and a bottom layer 24B of suitable material.

In embodiments of the present invention, the components of the hat may be constructed from any suitable material(s) utilized in the hat making industry. These materials may include, for example, fabrics constructed of natural fibers (e.g., cotton, wool, etc.), synthetic fibers (e.g., nylon, polyester, etc.), coated fibers, impregnated fibers, etc., and combinations, blends, etc., thereof. In one embodiment, the top layer 24A is constructed of a waterproof or water resistant material or membrane, such as rubber, Gore-Tex, etc. In another embodiment, the bottom layer 24B may be constructed of a breathable material, including but not limited to synthetic mesh fabrics.

As constructed, the crown 22 and the brim 24 form a hat body that defines an open ended, inner cavity 34 for receiving the user's head. An optional strap 26 (See FIG. 7) extends beneath the hat 20 from either the crown 24 or the brim 26 for retaining the hat on the user's head. The strap 26 may be any presently known or future developed strap capable of retaining the hat 20 on the user's head.

Referring now to FIGS. 2-4A, one exemplary embodiment of a first ventilating system of the hat 20 will now be described in more detail. Generally described, the first ventilation system is configured and arranged to allow air to circulate between the inner cavity 34 and the exterior of the hat 20, thereby providing a cooling effect to the user. As best shown in the embodiment of FIGS. 2-4A, the lower crown portion 32 comprises an inner band 38 and an outer band 40. The inner band 38 includes an upwardly extended sidewall 44 that defines the perimeter of the opening to the inner cavity 34. The sidewall 44 includes a plurality of apertures 48 spaced apart as the inner band 38 extends about the inner cavity. The apertures 48 are somewhat oversized to allow large quantities of air to transfer through the inner band side wall 44. In an alternative embodiment, the inner band 38 may be constructed out of mesh or the apertures can be filled with mesh or other material that provides air flow through the inner band 38. In use, one embodiment of the inner band 38 is positioned in relation to the remaining portions of the hat 20 so as to be in intermittent contact with the user's head. In this embodiment, it may be desired to reduce the side wall contact area as much as possible in order to reduce the heat effects on the user's head.

Figure 4A:
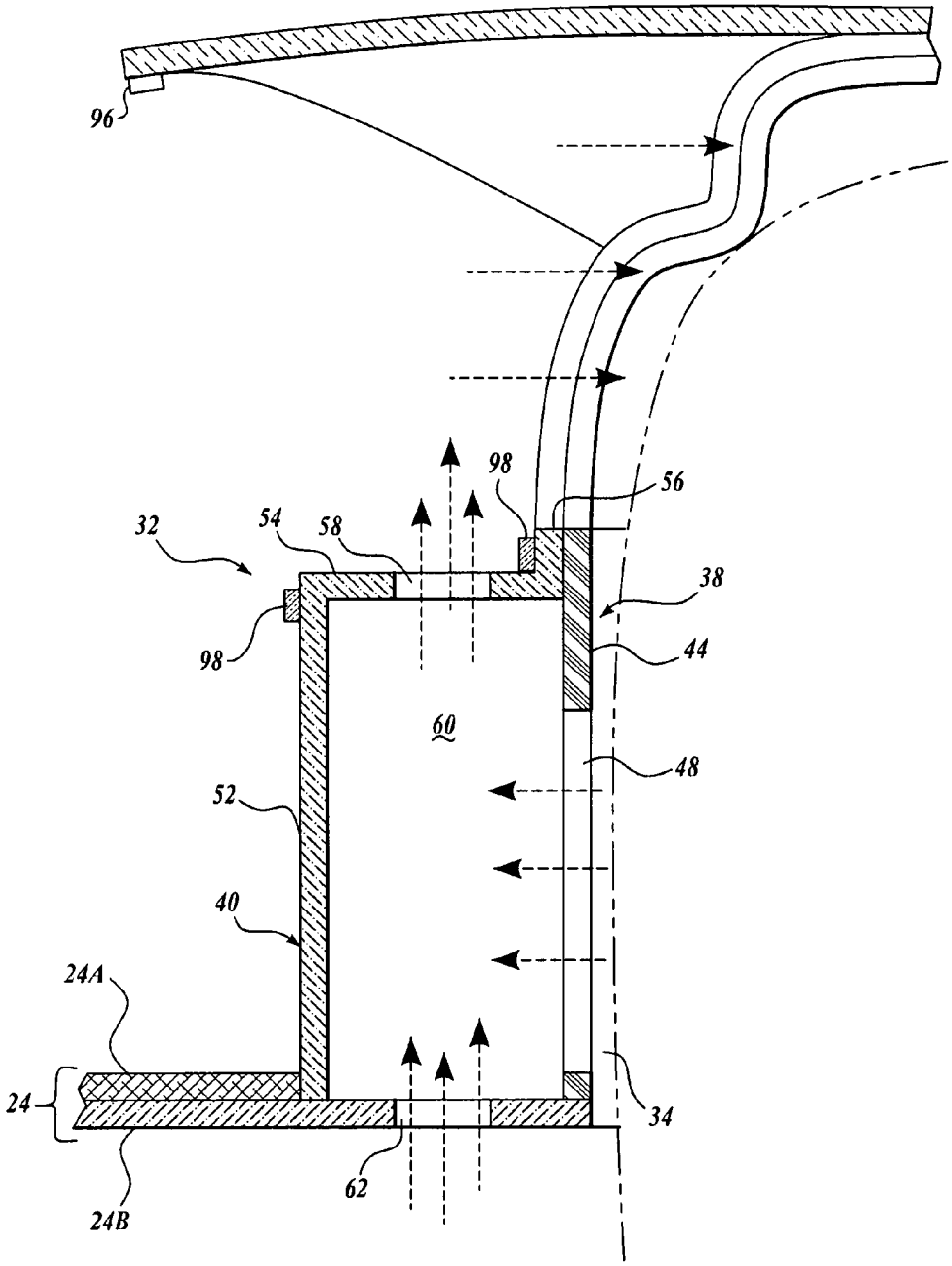
FIG. 4A is a partial cross-sectional schematic view of the hat of FIG. 1, wherein the first ventilation system in the "open" position.

The outer band 40 is spaced outwardly from and encircles the inner band 38. The outer band 40 comprises a sidewall 52 that extends upwardly, approximately vertically from the top layer 24A of brim 24, and a rim 54 that extends inwardly from the upper edge of the sidewall 52 to the top portion or edge of the inner band 38. In the embodiment shown, the sidewall 52 extends approximately vertically from the top layer and is somewhat planar in shape, although other orientations, such as transverse, or shapes, such as arcuate, may be employed. The rim 54 is secured to the top portion or edge of the inner band 38 via stitching, adhesive, or other known fastening techniques. In the embodiment shown, an inner lip 56 or the like is used for aiding in the securement of the rim 54 to the inner band 38. The outer band 40 is preferably solid along its sidewall 52 and is formed with spaced apart apertures or slots 58 in the rim 54 as the rim extends around the lower crown portion 32. In one embodiment, the slots 58 or apertures may be formed from a mesh fabric or other material that provides air flow through the outer band 38. At the lower end or edge of the sidewall 52, a portion of the brim, such as bottom layer 24B, extends to the lower edge of the inner band 38, as best shown in FIGS. 3 and 4A. In one embodiment, the bottom layer 24B of the brim 24 is secured to the lower edge of the inner band 38 via stitching, adhesive, or other known fastening techniques.

As such, the inner band 38, the outer band 40, and the inner portion of the brim 24 define a ventilation chamber 60 (See FIG. 4A) disposed in fluid communication with the apertures 48 of the inner band 38 and the slots 58 of the rim 54 for allowing air to pass between the inner cavity 34, the ventilation chamber 60, and the exterior of the hat 20. This forms one exemplary embodiment of the first ventilation system. It will be appreciated that multiple chambers may be formed around the lower crown portion by dividing the ventilation chamber via cross members, if desired. Therefore, embodiments of the first ventilation system may include a single ventilation chamber that extends around the entire lower crown portion or portions thereof, or may include one or more ventilation chambers that extend around a portion or portions of the lower crown portion 32 of the hat 20.

As best shown in FIGS. 3, 4A, 4C, and 4D, one embodiment of the brim 24 further includes apertures or slots 62 disposed in the bottom layer 24B of the brim 24 between the inner and outer bands 38 and 40. In one embodiment, the apertures or slots 62 can be formed by mesh fabric or other material that provides air flow through the brim 24. The slots 62 may be positioned so as to be in approximate vertical alignment with the apertures or slots 58 of the rim 54. As such, the apertures or slots 62, in conjunction with the corresponding apertures or slots 58 of the rim 54 and the apertures 48 of the inner band 38, form another exemplary embodiment of the first ventilation system. While a portion of the brim 24 (shown as a portion of bottom layer 24B) is described as extending from the lower edge of the outer band 40 to the inner band 38, thereby delineating the lower crown portion in conjunction with the outer and inner bands, this portion of the brim for purposes of understanding one or more of the appended claims may be in some instances considered part of the lower crown portion.

In use, convection forces cause warm air to transfer from the inner cavity 34 to the ventilation chamber 60 via the apertures 48. This air transfer warms the air in the ventilation chamber 60, which in turn, rises and exits through the upper apertures or slots 58. This upward movement of air pulls colder air from below the brim up through the optional apertures or slots 62 of the brim 24 and/or the space between the head of the user and the inner band 38, thereby creating an exemplary air cooling ventilation pattern, as shown by the arrows in FIG. 4A. It will be appreciated that conductive heat transfer may also occur between the user and portions of the hat, such as the inner band 38. Such conductive heat transfer, in turn, may transfer from the inner band 38 to the air in ventilation chamber 60.

Figure 4B:
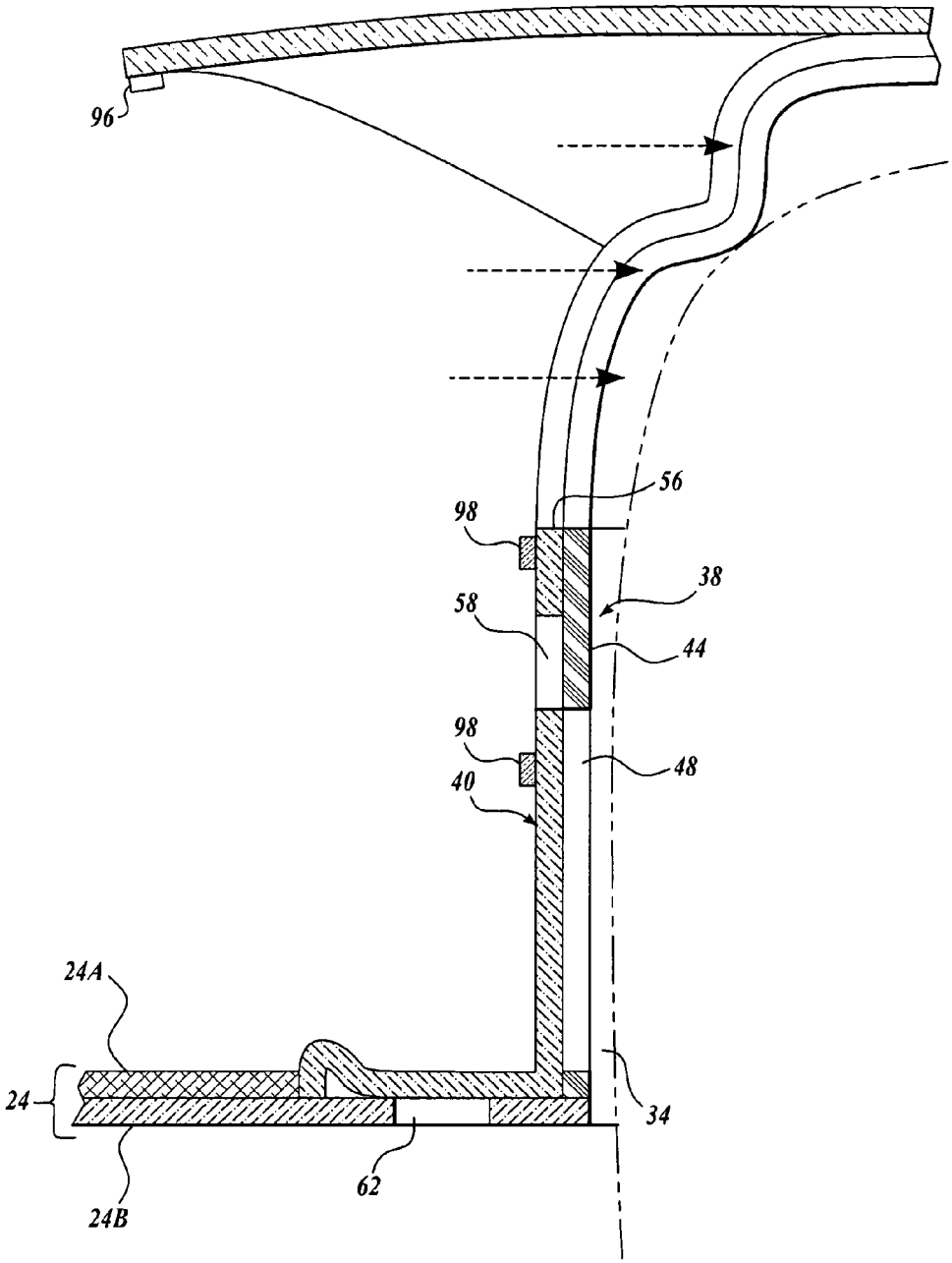
FIG. 4B is a partial cross-sectional schematic view of the hat of FIG. 1, wherein the first ventilation system in the "closed" position.
Figure 4C:
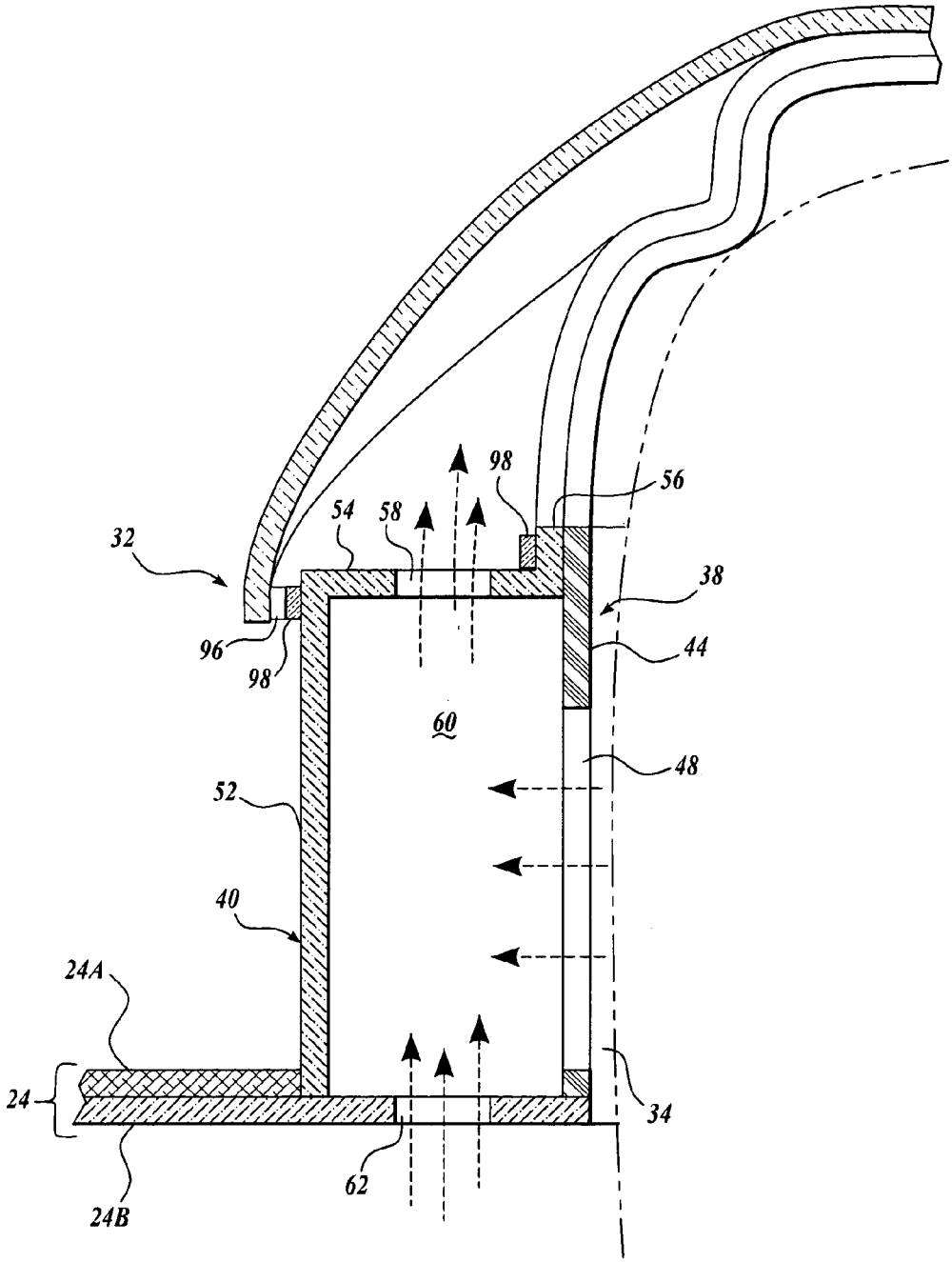
FIG. 4C a partial cross-sectional schematic view of the hat of FIG. 1 in a first closed position.
Figure 4D:
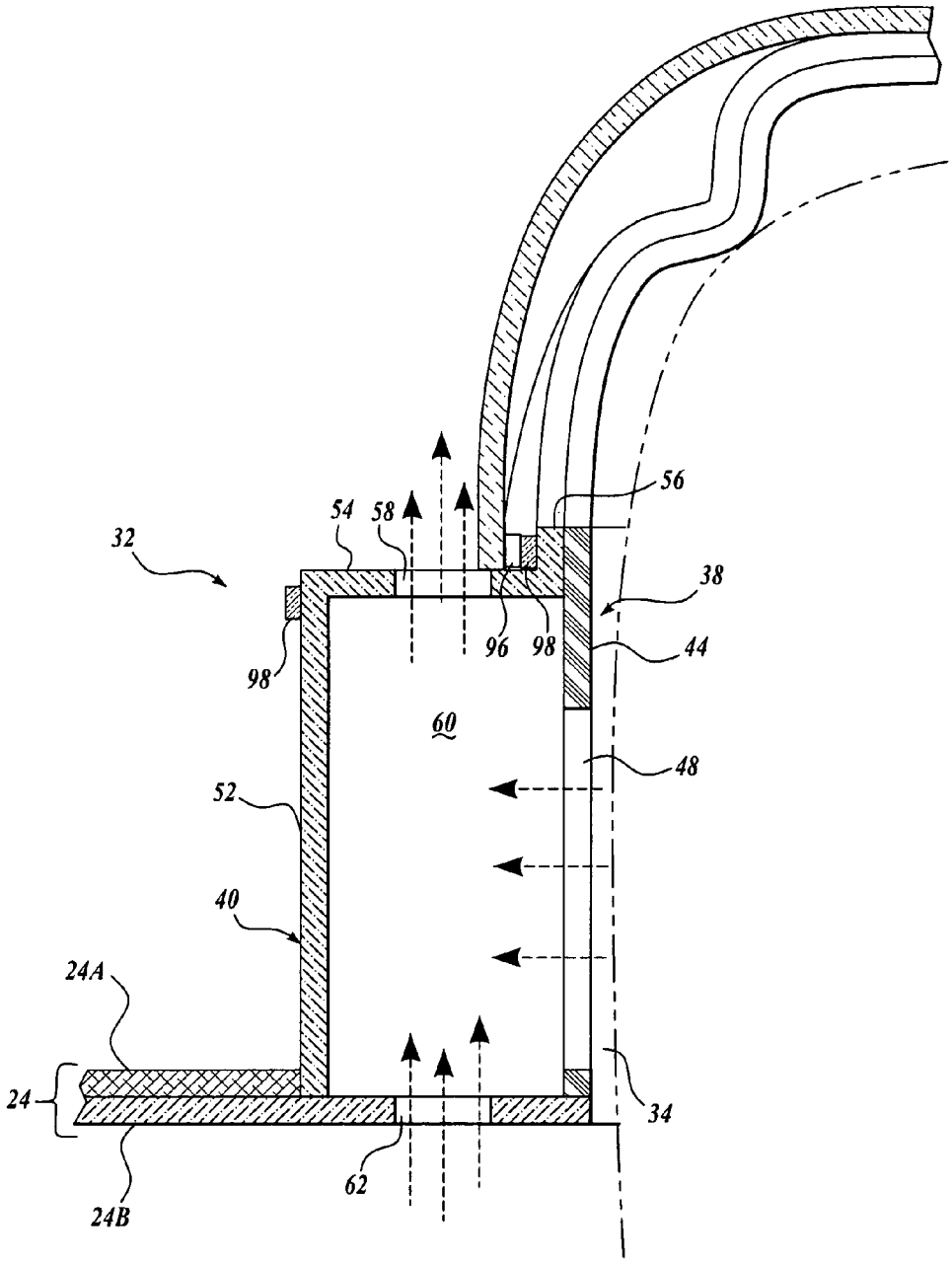
FIG. 4D a partial cross-sectional schematic view of the hat of FIG. 1 in a second closed position.
Figure 4E:
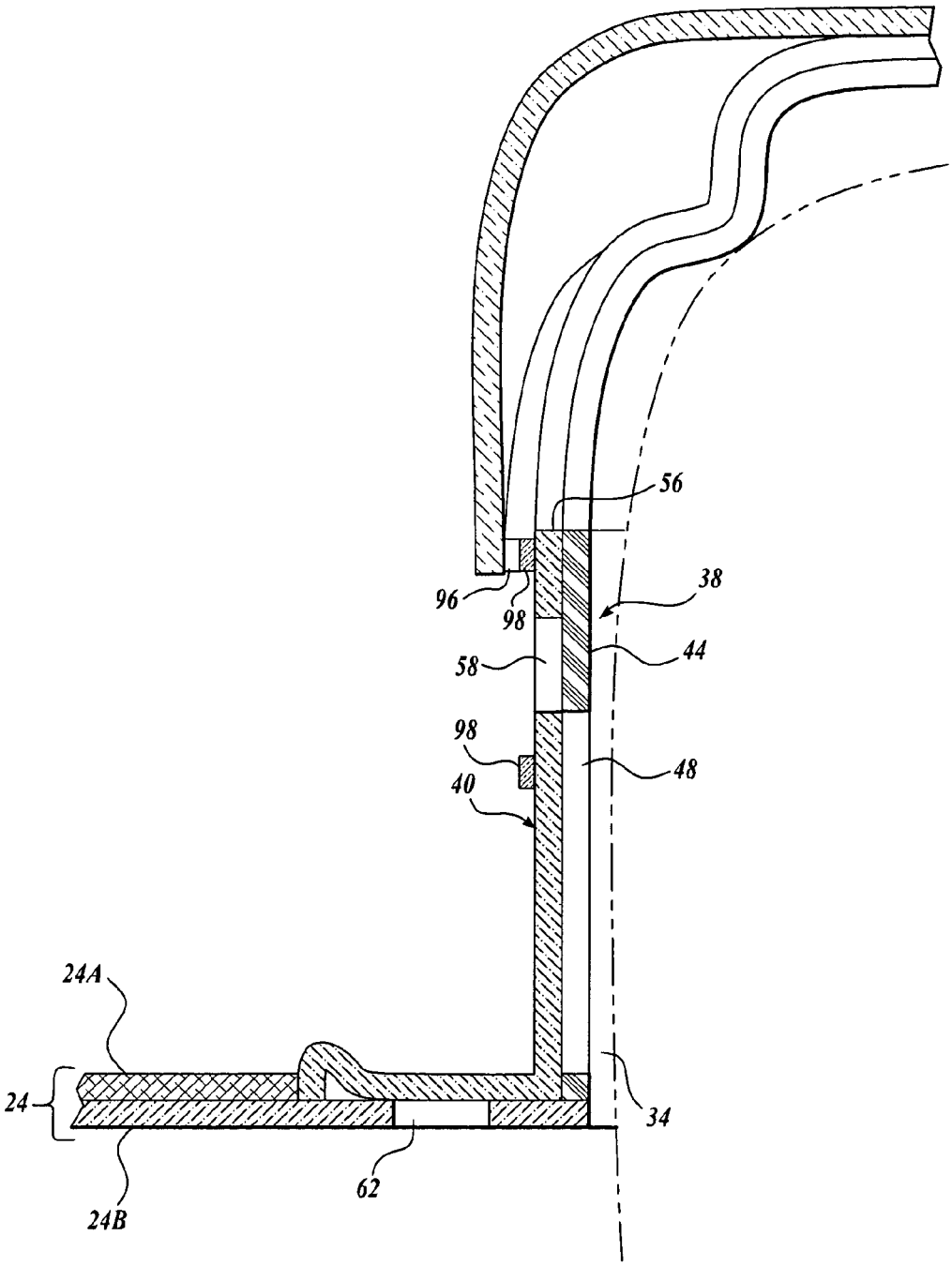
FIG. 4E a partial cross-sectional schematic view of the hat of FIG. 1 in a third closed position.

In one embodiment, the outer band 40 may be constructed out of suitable material so that the outer band 40 may collapse inwardly onto the inner band 38 as shown in FIGS. 4B and 4E. In this position, ventilation through the apertures 48 and slots 58 is blocked. In this position, ventilation may still occur as indicated by the arrows in FIG. 4B via the opening formed between the top of the lower crown portion 32 and the bottom of upper crown portion (also referred to as a second ventilation system), as will be described in more detail below.

Figure 11:
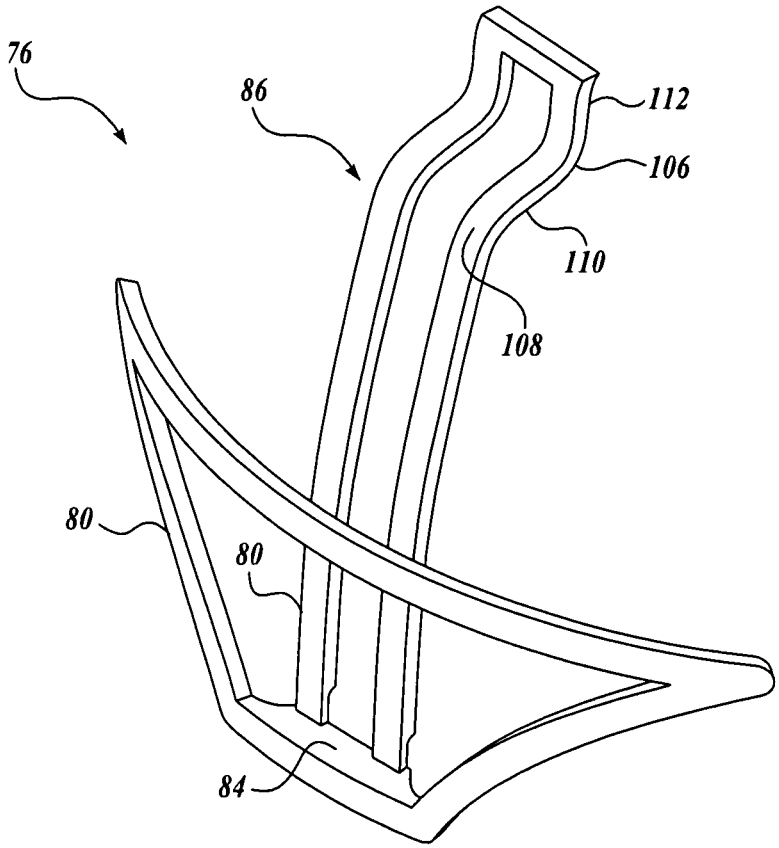
FIG. 11 is perspective view of one embodiments of a support/spacer formed in accordance with aspects of the present invention.

The lower crown portion 32 and the brim 24 may be configured and/or constructed of suitable materials to provide sufficient rigidity for forming and maintaining the one or more ventilation chambers 60, and for providing the overall shape of the hat 20. It will be appreciated that any known means for enhancing rigidity or reinforcing portions of the lower crown portion 32 and the brim 24 may be practiced with embodiments of the present invention. Additionally or alternatively, the hat 20 may include support/spacers 76 for adding rigidity to portions of the hat and/or defining the ventilation chamber(s). In one embodiment shown in FIGS. 3 and 11, the support/spacers 76 comprise an inner leg section 80, an outer leg section 82, and a cross member 84 integrally connected between the lower ends of the inner and outer leg sections. The support/spacers 76 may be constructed out of any suitable lightweight and durable plastic or like material. When assembled in the hat, the support/spacers 76 may be fixed in place via stitching, adhesive, etc., whereby the inner leg section 80 supports the inner band 38, the outer leg section 82 supports the outer band 40, and the cross member 84 helps define the geometry of the ventilation chamber(s) 60.

Figure 8:
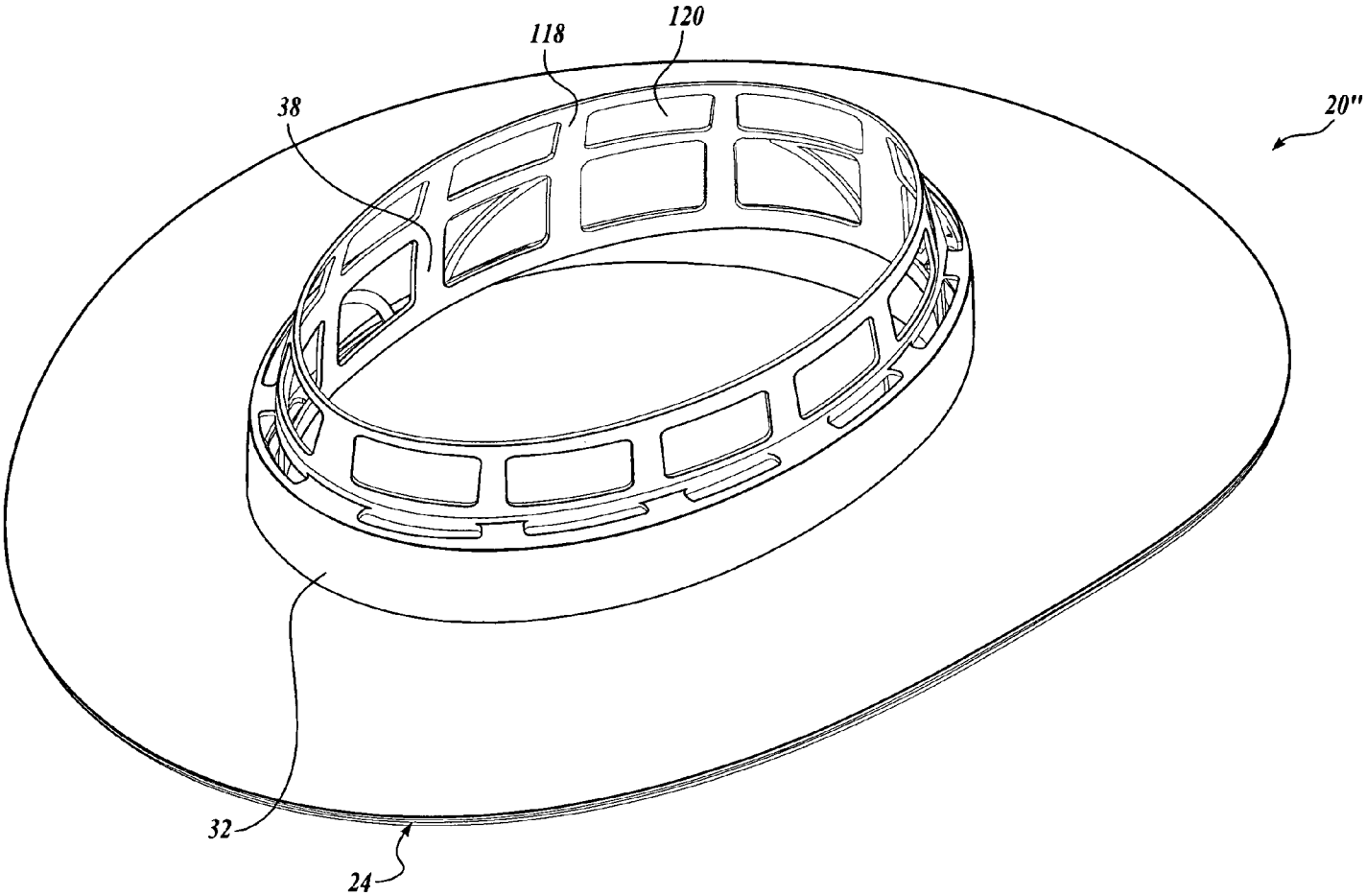
FIG. 8 is a perspective view of yet another embodiment of a hat constructed in accordance with aspects of the present invention, wherein the upper crown portion has been removed.
Figure 9:
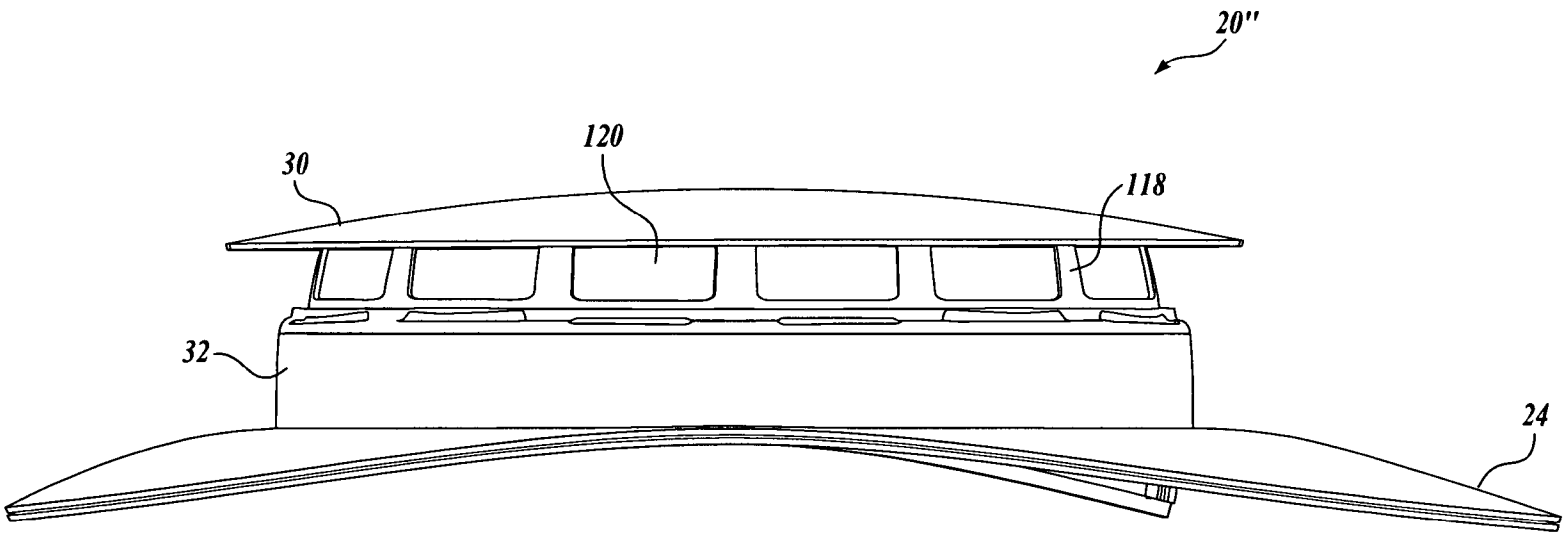
FIG. 9 is a side view of the hat depicted in FIG. 8, with the upper crown portion selectively attached and disposed in a ventilation position.

In one embodiment, an upper portion 86 of the inner leg section 80 of the support/spacers 76 may extend upwardly past the lower crown section 32 to provide support to the upper crown portion 30. In these embodiments, the top of the upper portion 86 of inner leg sections 80 support the upper crown portion 30 while the sides of the support/spacers 76 support the sides of the upper crown portion 30. In the embodiment shown, the inner leg sections 80 are jacketed by suitable materials, including an inner jacket portion 88 and an outer jacket portion 90, which may be integrally formed as part of the inner band 38 and the outer band 40, respectively. These layers may be designed to augment the support of the supports/spacers. Alternatively, these layers may support the upper crown portion in lieu of the upper portion 86 of the support/spacers 76. For example, in an alternative embodiment shown in FIGS. 8 and 9, the support/spacers 76 omit the upper portion 86 and the inner band 38 extends upwardly past the top of the outer band 40 as upper inner band portion 118. In these embodiments, the inner band 38 can be configured with sufficient rigidity for supporting the upper crown portion of the hat 20. It will be appreciated that the support/spacers 76 can be omitted in this embodiment. As shown in FIGS. 8 and 9, the upper inner band portion 118 may include apertures 120 to promote ventilation between the user and the environment, as will be described in more detail below.

In one embodiment, the top of the spacer jacket is secured to the top region 104 of the upper crown portion 30. To provide additional cooling to the user, the upper portion 86 of the support/spacers 76 may be configured to support the top region of the upper crown portion 30 a spaced distance above the top of the user's head (See FIGS. 4A and 4B). In one embodiment, the upper portion 86 of the support/spacers 76 are formed with first and second elbows 106 and 108 (See FIG. 11), a lower, somewhat horizontal portion 110 for providing a contact region that interfaces with the head of the user, and an upper, somewhat vertical portion 112 that supports the upper crown portion 30 a spaced distance from the top of the user's head. The support/spacers 76 may also be configured with third and fourth elbows (not shown) positioned below and outwardly of the first and second elbows in order to provide lateral space between the user's head and the support/spacer to lessen the effects of conductive heat transfer and to promote additional airflow through the hat, over the user's head, etc.

In accordance with other aspects of the present invention, the crown 22 may be configured to provide additional ventilation capabilities to the hat. In several embodiments, the upper crown portion 30 may be a discrete component apart from the lower crown portion 32, as best shown in FIGS. 3, 4A-4B, and 9. When assembled, the top region 104 of the upper crown portion 30 is secured to the remainder of the hat 20. For example, the top region 104 of the upper crown portion 30 may be either mounted onto the top portions of the jacketed support/spacers 76 or onto the top of upper inner band portion 118, as shown, for example, in FIG. 9. In one embodiment, the lower perimeter region 110 of the upper crown portion 30 extends downwardly along the sides, the front, and the back of the user's head and may be configured to selectively attach to the lower crown portion 32 via one or more suitable fasteners. For example, hook and loop fastener components 96 and 98 (See FIGS. 4A and 4B) may be employed, although other cooperatingly configured fasteners may be used, such as snaps, buttons, zippers, etc. Alternatively, other fasteners may be used that are primarily mounted to one of the two components while selectively attaching to the other of the two components, such as clips, clamps, etc. In other embodiments, the lower crown portion 32 may be held in contact or close proximity to the lower crown portion 32 with the use of, for example, pull strings, etc.

When the lower perimeter region 110 is selectively attached to the lower crown portion 32, the lower edge thereof either overlaps or abuts the inner crown portion 32, as shown in FIGS. 4C and 4D, respectively, forming first and second closed positions, thereby protecting the user from the elements. In some embodiments, to tightly surround the lower crown portion 32, excess material on both sides of the upper crown portion may be folded over and secured to itself, as shown as reference numeral 114 in FIG. 1, using any suitable fastening techniques, such as snaps, buttons, hoop and loop fasteners, etc.

To provide additional ventilation capabilities to the hat 20, one or more sections of the lower perimeter region 110 may be detached, removed from close proximity, etc., from the lower crown portion 32, and in one embodiment, be folded upwardly in an outward manner, thereby exposing the inner cavity 34 to the exterior of the hat 20. This forms one or more ventilation positions of the upper crown portion 30 of the hat 20. To keep these sections folded upwardly, the outside of the upper crown portion 30 and/or the lower perimeter region may include suitable fasteners, e.g., snaps, buttons, hook and loop fasteners, to selectively fasten the lower perimeter region 110 to the top region 104 of the upper crown portion 30.

Figure 5:
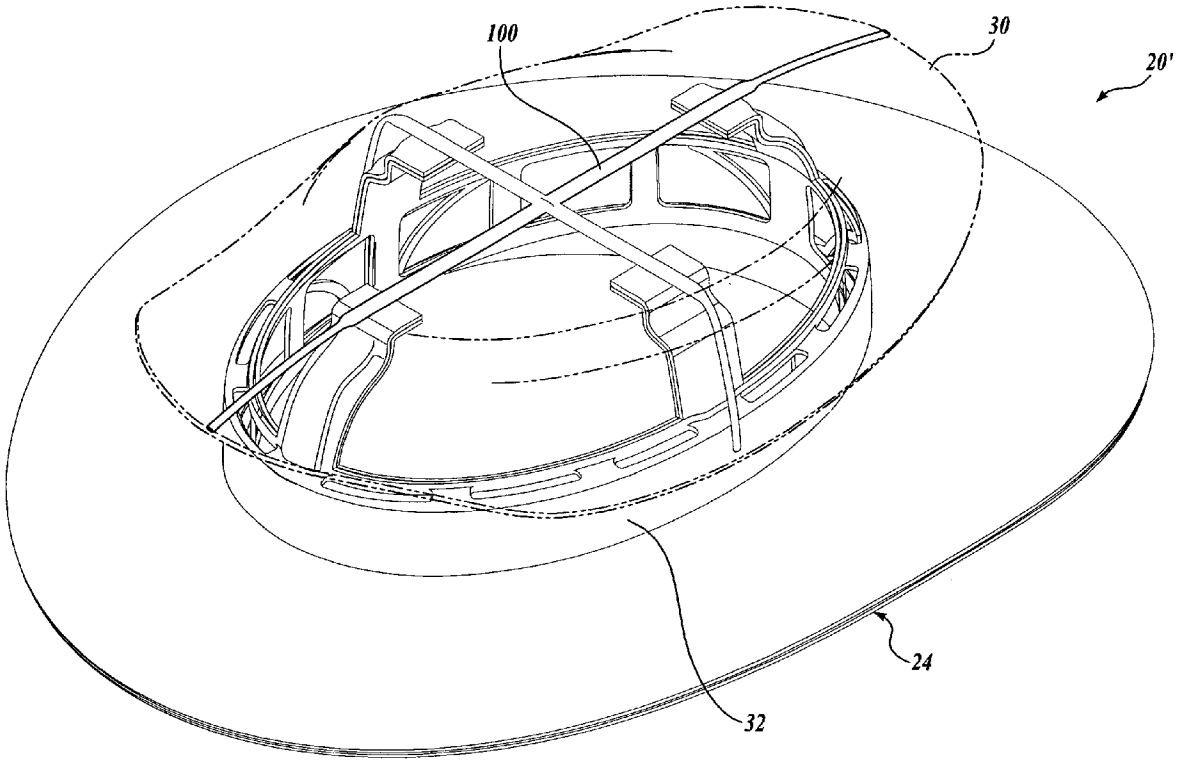
FIG. 5 is a perspective view of another embodiment of a hat with the upper crown portion in phantom to illustrate features thereof, wherein the upper crown portion is selectively attached to the lower crown portion at the sides of the hat.
Figure 6:
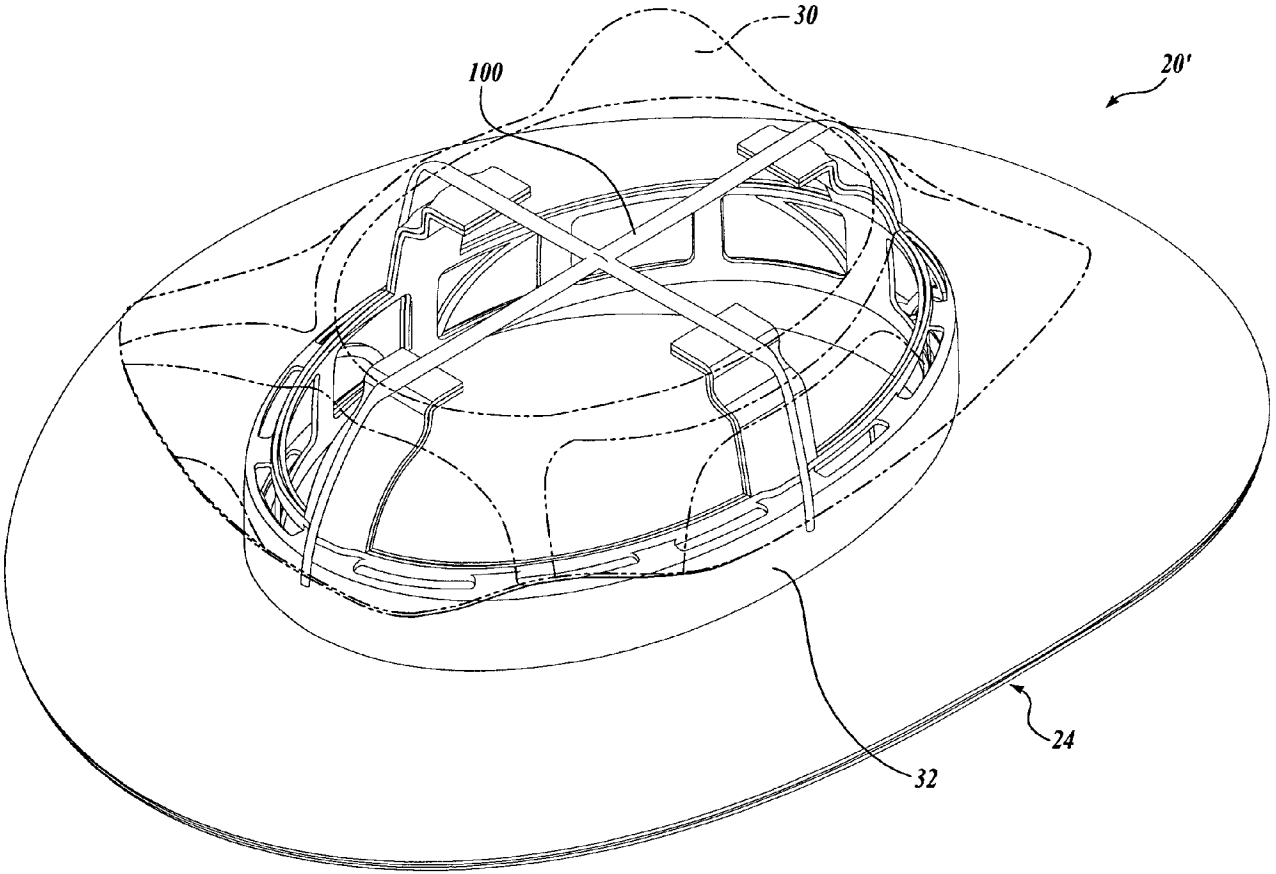
FIG. 6 is a perspective view of the hat of FIG. 5, wherein the upper crown portion is selectively attached to the lower crown portion at the front, back, and sides of the hat.

The upper crown portion 30 may include additional support structure or configured with increased rigidity, if desired, to support the upper crown portion 30 and to provide some shape thereto. For example, in one embodiment, as best shown in FIGS. 5 and 6, one or more cross members 100 may be included. The cross members 100 may be either embedded into the upper crown portion 30 or may be affixed to the inner surface thereof. In the embodiment shown, two perpendicularly disposed cross members 100 are utilized, although additional cross members maybe used. Alternatively, the upper crown portion 30 may include an internal air bladder that is selectively inflated/deflated to provide sufficient rigidity and/or provide the desired shape of the upper crown portion 30.

In several embodiments, either through the use of the internal air bladder, the cross members 100, and/or other rigidity enhancements to the upper crown portion 30, the upper crown portion 30 can be configured to be in a somewhat flat configuration (See FIG. 9) in its normal state, although other configurations of the upper crown portion are possible. In some embodiments, the cross members 100 may be constructed of suitable plastic or metallic material that is bendable, but has sufficient rigidity to return to its unbent state. To form one of the closed positions in use, the lower perimeter region 110 of the upper crown portion 30 is deflected downwardly toward the lower crown portion 32, thereby producing bias forces therein. The lower perimeter region 110 can be selectively attached to the lower crown portion 32 via one or more suitable fasteners.

In the embodiment shown in FIGS. 4A, 5 and 6, a portion 96 of the fastener may be secured to the bottom surface of the upper crown portion, with the cooperating fastener portion 98 being secured to the lower crown portion 32. To form one or more ventilation positions in use, one or more portions, for example, the front and back of the upper crown portion 30, are detached from the lower crown portion 32. Due to the biasing forces, for example, in the deflected cross members 100, the front and back portions of the upper crown portion 30 return to its normal position, as best shown in FIG. 5. In this position, the upper crown portion can protect the user from the elements while also allowing air from wind, movement of the user, etc., into the inner cavity and over the head of the user (See FIGS. 4A and 4B), thereby providing a cooling effect to the user.

While several ventilation features are provided by the lower crown portion and/or the upper crown portion, as shown in the examples above, it will be appreciated that air may enter and exit the hat in other areas or by other means. For example, air may enter/exit at locations around the inner band 38 at the interface between the inner band 38 and the head of the user. Moreover, the material or fabric used to construct portions of the hat, such as the upper crown portion, lower crown portion, etc., may include areas that are "breathable" or otherwise permit air flow through the material or fabric and into/out of the inner cavity 34.

Figure 7:
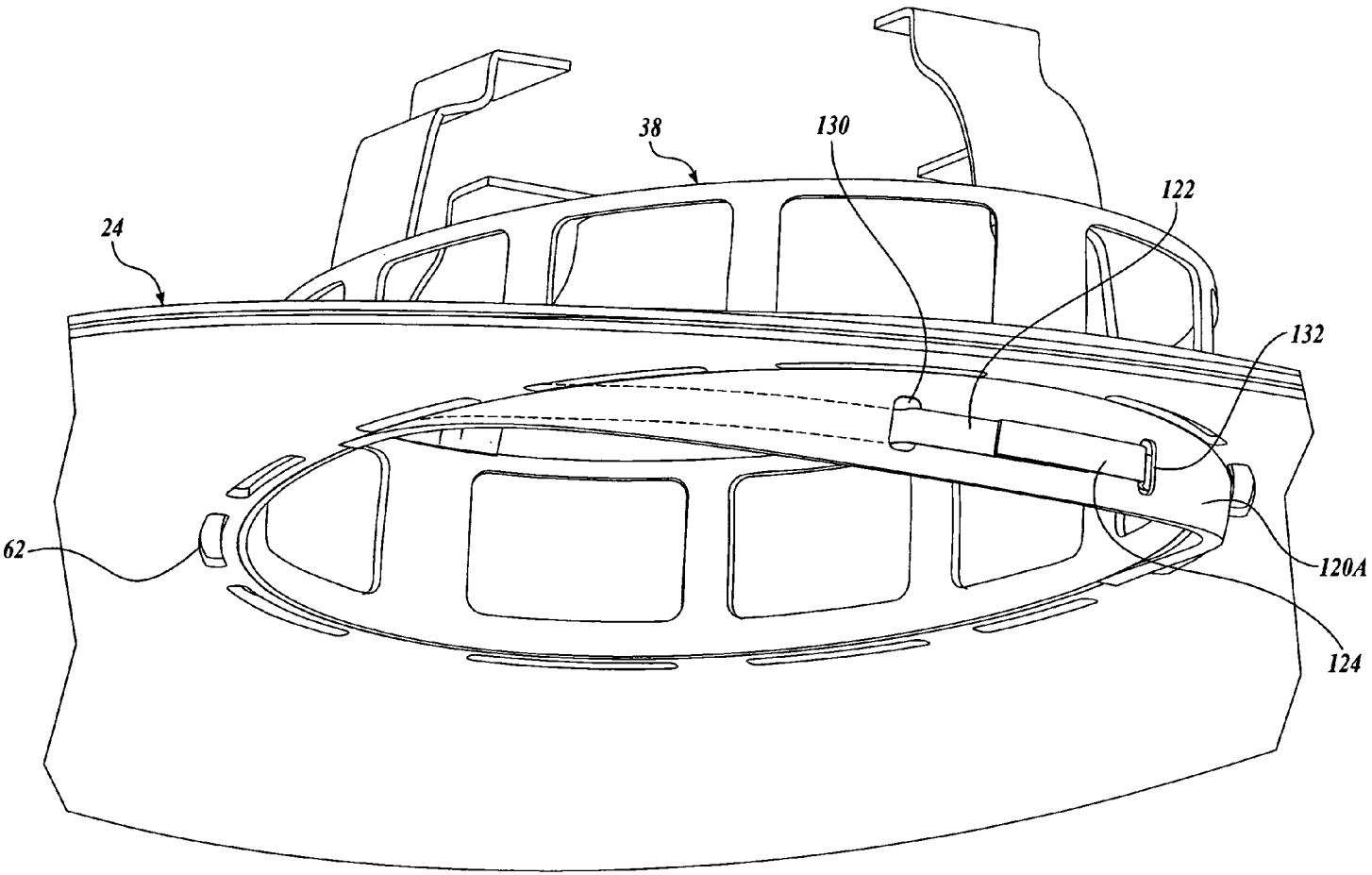
FIG. 7 is a bottom rear perspective view of the hat of FIG. 2, depicting one embodiment of a strap formed in accordance with aspects of the present invention.
Figure 10A:
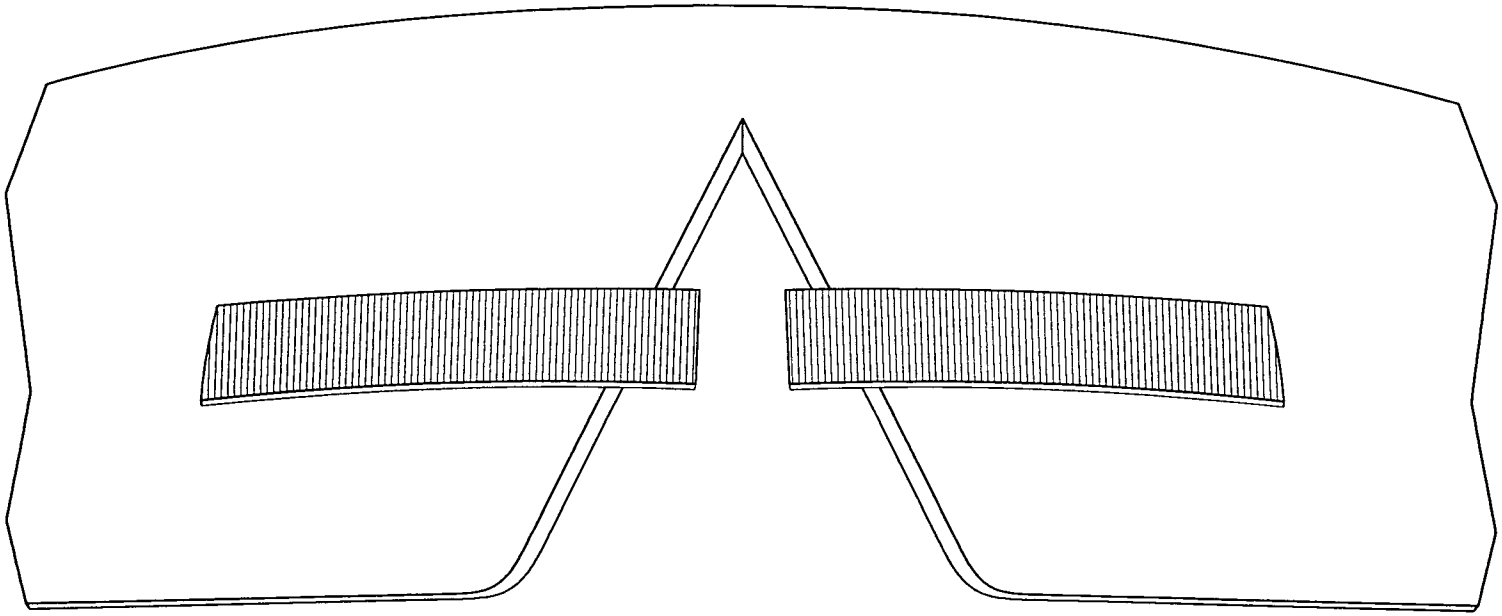
FIGS. 10A and 10B are alternative embodiments of a strap formed in accordance with aspects of the present invention.
Figure 10B:
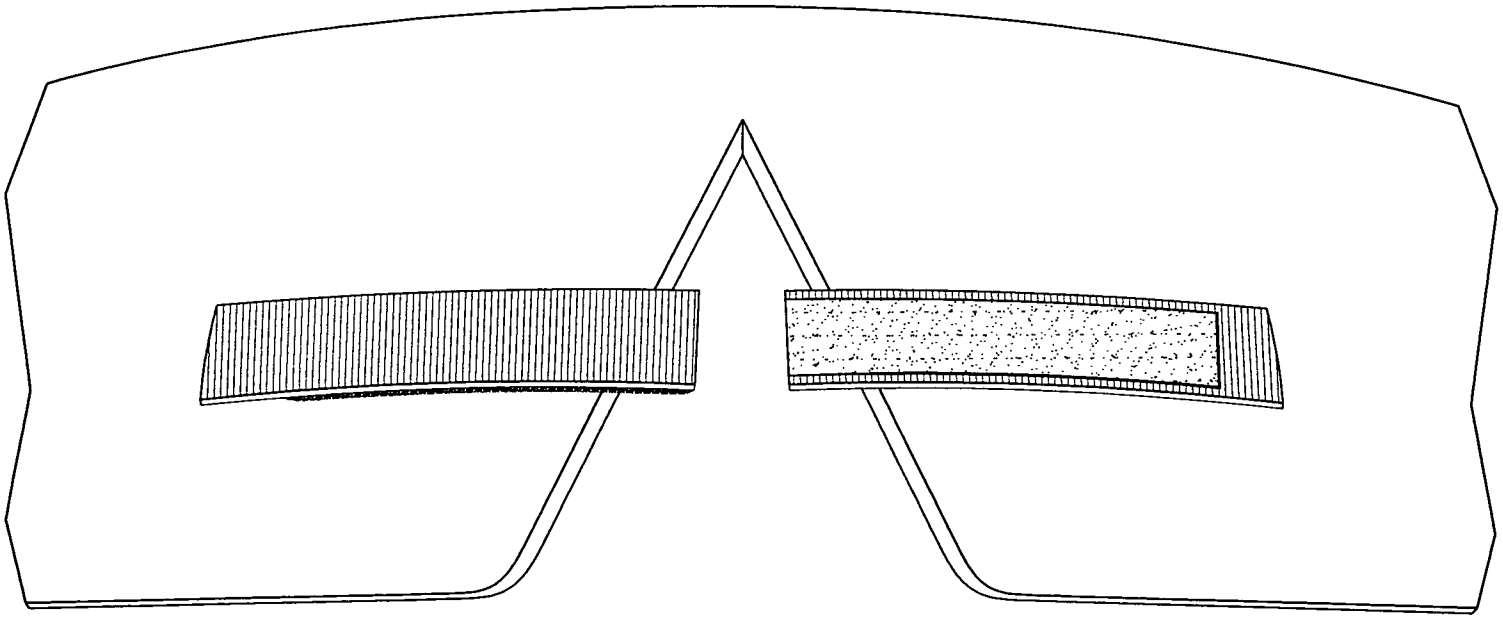

As described briefly above, an optional strap 26 may be provided to help retain the hat 20 on the user's head. One suitable strap that may be practiced in accordance with aspects of the present invention is depicted in FIG. 7. FIG. 7 is a bottom, rear perspective view of the hat 20 illustrating the strap 26. In the embodiment shown in FIG. 7 (and in FIG. 3), the strap 26 is comprised of at least one strip 120 of material, shown as back and front strips 120A and 120B that are anchored along the sides of the hat and extend rearwardly and downwardly from the sides of the brim 24, thereby forming a loop having a pocket or channel (not shown) therein. The strap 26 further includes left and right strap sections 122 and 124 discrete from and movable with respect to the strips 120A and 120B. The left and right strap sections are likewise anchored to the sides of the hat 20 and extend along the pocket or channel of the strip 120. The ends of the left and right strap sections 122 and 124 extend through openings 130 and 132, respectively, in the rear of the loop. The ends of the strap sections include adjustable fastening means, such as hook and loop fasteners, buttons, snaps, etc. in order to selectively tighten the strap 26 around the back of the user's head. Alternative embodiments of the strap 26 are illustrated in FIGS. 10A and 10B.

The principles, representative embodiments, and modes of operation of the present invention have been described in the foregoing description. However, aspects of the present invention which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present invention. Accordingly, it is expressly intended that all such variations, changes, and equivalents fall within the spirit and scope of the present invention, as claimed.

The embodiments of the invention in which an exclusive property or privilege is claimed are defined as follows:

1. A hat, comprising:

a crown defining an open ended cavity configured to receive a head of a user, wherein the crown includes an inner band and an outer band spaced a distance outwardly from the inner band;

a brim extending around at least a portion of a lower portion of the crown;

a ventilation system associated with the crown and configured to provide ventilation to a user of the hat, the ventilation system comprising at least one chamber defined by the inner band and the outer band, at least one first chamber opening disposed in the inner band and connecting the at least one first chamber in fluid communication with the open ended cavity, at least one second chamber opening disposed in the outer band and connecting the at least one first chamber in fluid communication with an exterior of the hat, and at least one aperture disposed in the brim and connected in fluid communication with the at least one first chamber.

2. The hat of claim 1, further comprising means for enhancing rigidity of the crown.

3. The hat of claim 1, wherein the crown includes at least one support member that extends around a perimeter of a portion of the crown.

4. The hat of claim 3, wherein the at least one support member is a band that extends around the open ended cavity, wherein the band includes at least one aperture in fluid communication with the open ended cavity.

5. The hat of claim 4, wherein the band is disposed above and extends upwardly from the inner band.

6. The hat of claim 1, wherein the at least one aperture in the brim and the at least one second chamber opening are in substantial vertical alignment.

7. The hat of claim 1, wherein the crown is configured to provide additional ventilation to the open ended cavity of the hat.

8. The hat of claim 1, wherein the crown includes an upper crown portion having a top region and a lower perimeter region; and a lower crown portion that defines a perimeter of an opening of the open ended cavity.

9. The hat of claim 8, further comprising a first support member interconnecting the top region of the upper crown portion and the lower crown portion and supporting the top region of the upper crown portion a spaced distance from the lower crown portion; and at least one fastener configured to selectively fasten at least a portion of the lower perimeter region of the upper crown portion to the lower crown portion.

10. The hat of claim 9, further comprising first and second support members configured to interconnect the top region of the upper crown portion and the lower crown portion and support the top region of the upper crown portion a spaced distance from the lower crown portion, the first and second support members having a top surface for connecting to the top region of the upper crown portion and a user interface area spaced from the top surface thereby creating an air gap between the head of the user and the top of the upper crown portion when the hat is placed on the head of the user.

11. The hat of claim 1, further comprising a strap associated with the crown or brim, the strap configured to interface with a head of a user for retaining the hat thereon.

12. The hat of claim 11, wherein the strap is size adjustable.

13. The hat of claim 1, further comprising hat retaining means, wherein the hat retaining means is coupled to the brim or crown of the hat and extends below the crown and brim of the hat.

14. A hat, comprising:

a crown defining an open ended inner cavity, the crown having discrete upper and lower portions selectively coupled to one another, the crown having a closed position, wherein the upper portion is coupled to the lower portion, and a ventilation position, wherein at least a portion of the upper crown portion is decoupled from the lower crown portion and provides access to the inner cavity; and a brim extending around at least a portion of the lower portion of the crown, wherein the lower portion of the crown includes upright inner and outer walls connected to a portion of the brim in a spaced apart manner, thereby forming a ventilation chamber; and a plurality of first apertures configured to place the ventilation chamber in fluid communication with the interior cavity, and a plurality of second apertures configured to place the ventilation chamber in fluid communication with an exterior of the hat, wherein the brim includes a plurality of apertures connected in fluid communication with the ventilation chamber.

* * * * *